US007566278B2

(12) United States Patent
Jackson

(10) Patent No.: US 7,566,278 B2
(45) Date of Patent: Jul. 28, 2009

(54) GOLF SWING AID

(75) Inventor: Elfrem Jackson, 3480 Greenbriar Pkwy. SW., Suite 212, Atlanta, GA (US) 30331

(73) Assignee: Elfrem Jackson, Atlanta, GA (US)

( * ) Notice: Subject to any disclaimer, the term of this patent is extended or adjusted under 35 U.S.C. 154(b) by 265 days.

(21) Appl. No.: 11/743,491

(22) Filed: May 2, 2007

(65) Prior Publication Data

US 2008/0274820 A1 Nov. 6, 2008

(51) Int. Cl.
*A63B 69/36* (2006.01)

(52) U.S. Cl. ..... 473/266; 473/269; 473/270

(58) Field of Classification Search ..... 473/218, 473/266, 269, 270, 271, 272, 273
See application file for complete search history.

(56) References Cited

U.S. PATENT DOCUMENTS 4,651,994 A * 3/1987 Lee ..... 473/271
4,659,084 A * 4/1987 Vuick ..... 473/264
5,328,186 A * 7/1994 Hanson et al. ..... 473/218
6,024,656 A * 2/2000 Lane ..... 473/409

* cited by examiner

*Primary Examiner*—Nini Legesse
(74) *Attorney, Agent, or Firm*—Nelson Mullins Riley & Scarborough, LLP

(57) ABSTRACT

A golf swing aid for assisting a golf player in properly maintaining alignment, balance, and lower body biomechanics during a golf swing comprising a base having a bottom surface and a top surface; a vertical support post having a first end, a second end, a longitudinal axis, a first region proximate to the vertical post first end, a second region proximate to the second end, and a plurality of adjustment holes defined through the second region; a first adjustment rod having a first end, and a second end; and a second adjustment rod having a first end, a second end, and a flange extending from the second adjustment rod first end; wherein the first and second adjustment rod first ends each engage one of the vertical post adjustment holes to releasably mount the adjustment rods to the vertical support post second region.

18 Claims, 5 Drawing Sheets

GOLF SWING AID

FIELD OF THE INVENTION

The present invention relates to golf improvement aids and, in particular, to a device for teaching a golfer the proper position of the legs while swinging a golf club.

BACKGROUND OF THE INVENTION

In order to consistently improve his or her performance on the golf course, a golfer must successfully combine strength, balance, and body control into a repeatable golf swing that yields predictable results. Even the most infinitesimal imperfections in the golf swing can adversely affect a player's ability to successfully advance the golf ball towards the pin. Such minute imperfections may be imperceptible to the player and, therefore, difficult or impossible to identify and correct. Additionally, the particular aspects of the type of golf club the player is swinging, such as shaft length and club face loft, can compound minute swing imperfections with disastrous results.

A number of golf improvement aids are currently available that are designed to improve one or more of the many facets of a golfer's swing. Such aids typically focus on resolving one particular deficiency or reinforcing one particular fundamental aspect of the game. For example, many aids are available that will prevent a player from swaying backward or forward during the golf swing, because an exaggerated swaying movement can result in an errant shot. Some aids help players improve their fundamentals such as bodily alignment, stance and ball placement prior to swinging a golf club, while other aids may assist players in ensuring that their lower bodies remain relatively still while swinging the golf club so as to minimize the likelihood of an errant golf shot. Still other aids train players to execute particular golf shots, such as putts, chip shots, long irons shots, and drives. While each of the prior golf aids may offer golfers assistance in one particular aspect of the game, few known golf aid provides universal assistance in all phases of the game. Additionally, few known golf aids offer golfers universal assistance in alignment, stance, and lower body biomechanics, while being equally effective to both right-and-left-handed golfers and accommodating golfers of varying heights. Additionally, many golf aids are cumbersome and are not easily transportable or easy to set up and use. Thus, the golfer is not likely to use them at a driving range or on a course.

The present invention seeks to provide universal assistance in all phases of the golf game, as well as providing an adjustability that allows the aid to assist all golfers with their alignment, stance, and lower body biomechanics regardless of the golfer's dexterity or height and regardless of what phase of the game the player is attempting to improve.

SUMMARY OF THE INVENTION

The present invention recognizes and addresses considerations of prior art constructions and methods.

In one embodiment of the present invention, a golf swing aid is provided for assisting a golf player in properly maintaining alignment, balance, and lower body biomechanics during a golf swing comprising a base having bottom surface and a top surface; a vertical support post having a first end, a second end, a longitudinal axis, a first region proximate to the vertical post first end, a second region proximate to the second end, and a plurality of adjustment holes defined through the second region; a first adjustment rod having a first end, and a second end; and a second adjustment rod having a first end, a second end, and a flange extending from the second adjustment rod first end; wherein the first and second adjustment rod first ends each engage one of the vertical post adjustment holes to releasably mount the adjustment rods to the vertical support post second region.

In another embodiment, a golf swing aid is provided for assisting a golf player in properly maintaining alignment, balance, and lower body biomechanics at all times during a golf swing and in all phases of golf comprising a generally rectangular base having a bottom surface, a top surface, a longitudinal axis generally parallel to the bottom surface, and a transverse axis perpendicular to the base longitudinal axis; an elongated vertical support post having a first end, a second end, a longitudinal axis extending through the vertical support post first and second ends, a first region proximate to the vertical post first end that engages the base, a second region proximate to the second end, and a plurality of adjustment holes defined through the second region; an elongated first adjustment rod having a first end, a second end, a longitudinal axis passing through the first adjustment rod first and second ends, and a mounting post extending from the first adjustment rod first end; and an elongated second adjustment rod having a first end, a second end, a longitudinal axis passing through the second adjustment rod first and second ends, a flange extending from the second adjustment rod first end, and a mounting post extending from the second adjustment flange.

In still another embodiment, a golf swing aid is provided for assisting a golf player in properly maintaining alignment, balance, and lower body biomechanics at all times during a golf swing and in all phases of golf comprising a generally rectangular base having a bottom surface, a top surface, a longitudinal axis generally parallel to the bottom surface, a transverse axis perpendicular to the longitudinal axis and generally parallel to the bottom surface, a front wall extending between the base top and bottom surfaces, a rear wall extending between the base top and bottom surfaces, a right sidewall extending between the front and rear walls, and a left sidewall extending between the front and rear walls; an elongated vertical support post having a first end, a second end, a longitudinal axis extending through the vertical support post first and second ends, a first region proximate to the first end, a second region proximate to the second end, and a plurality of adjustment holes defined through the second region; an elongated first adjustment rod having a first end, a second end, a longitudinal axis passing through the first adjustment rod first and second ends, and a mounting post extending from the first adjustment rod first end; and an elongated second adjustment rod having a first end, a second end, a longitudinal axis passing through the second adjustment rod first and second ends, a flange extending from the second adjustment rod first end, and a mounting post extending from the flange.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
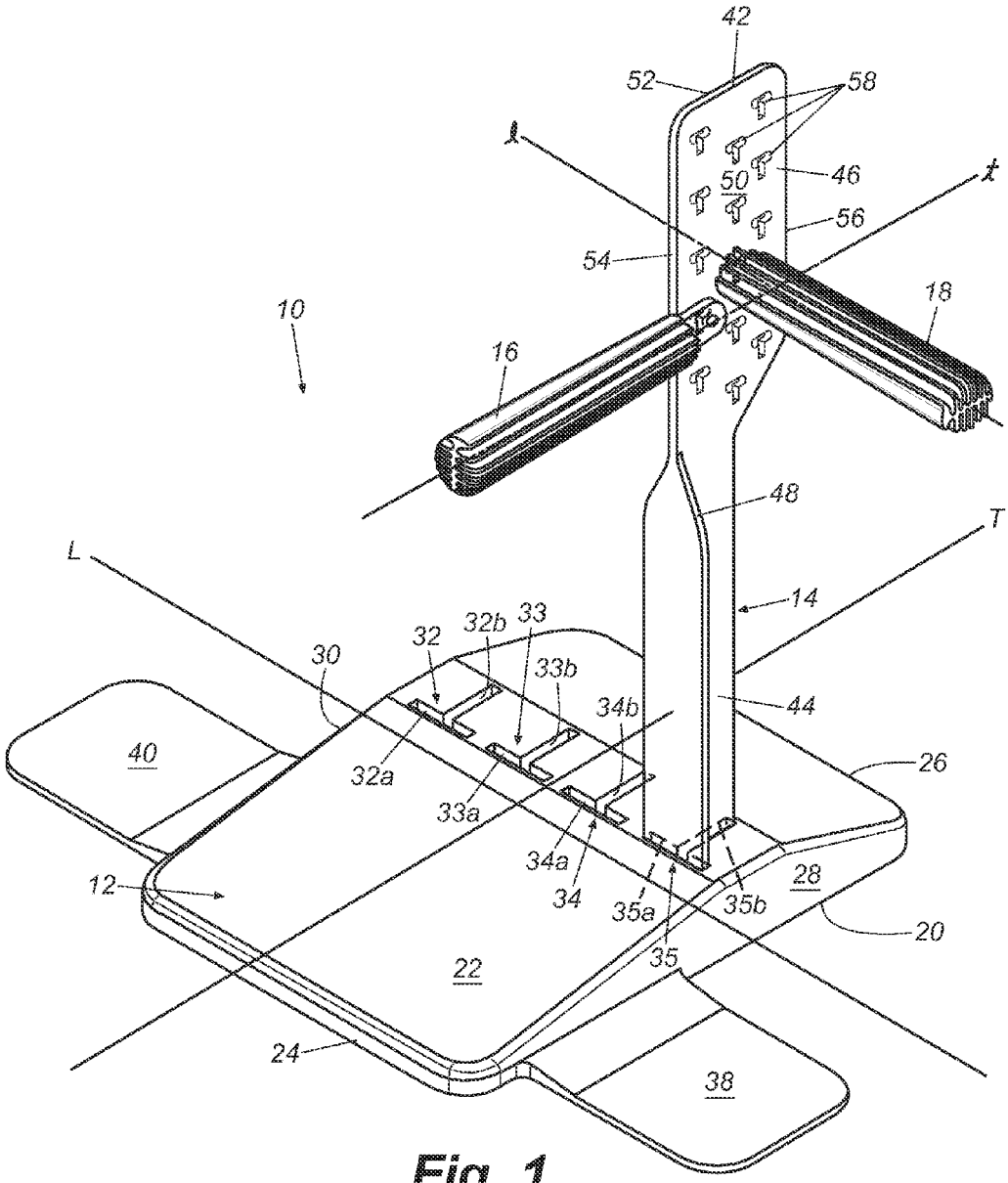
FIG. 1 is a front perspective view of a golf swing aid in accordance with the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring to FIG. 1, a golf swing aid 10 has a base 12, a vertical support post 14, a transverse adjustment rod 16, and a longitudinal adjustment rod 18. Base 12 has a longitudinal axis L and a transverse axis T. Base 12 also has a bottom surface 20 generally parallel to a plane encompassing both axes L and T, a top surface 22, a front wall surface 24 generally parallel to axis L and perpendicular to axis T, a rear wall surface 26 generally parallel to surface 24, and two side wall surfaces 28 and 30, both of which are generally parallel to axis T and perpendicular to axis L.

Base 12 may be fashioned out of a lightweight polymer such as plastic, but other suitable materials may also be used such as aluminum, steel or carbon composite. A plurality of T-shaped recesses 32, 33, 34, and 35 are formed in the base top surface 22 and are sized appropriately to releasably receive a first end 36 (FIG. 2) of vertical support post 14. Each recess has a respective flange portion 32*a*, 33*a*, 34*a* and 35*a* and a respective web portion 32*b*, 33*b*, 34*b* and 35*b*. The recesses are arranged so that the flange portions are positioned proximate to front wall surface 24 and aligned generally parallel to base longitudinal axis L. In one preferred embodiment, base 12 has four T-shaped recesses, but any number of recesses may be provided to increase or decrease the adjustability of the golf swing aid as discussed in further detail below. Base 12 is also equipped with two generally flat stability wings 38 and 40 that extend outwardly from side wall surfaces 28 and 30, respectively.

Figure 2:
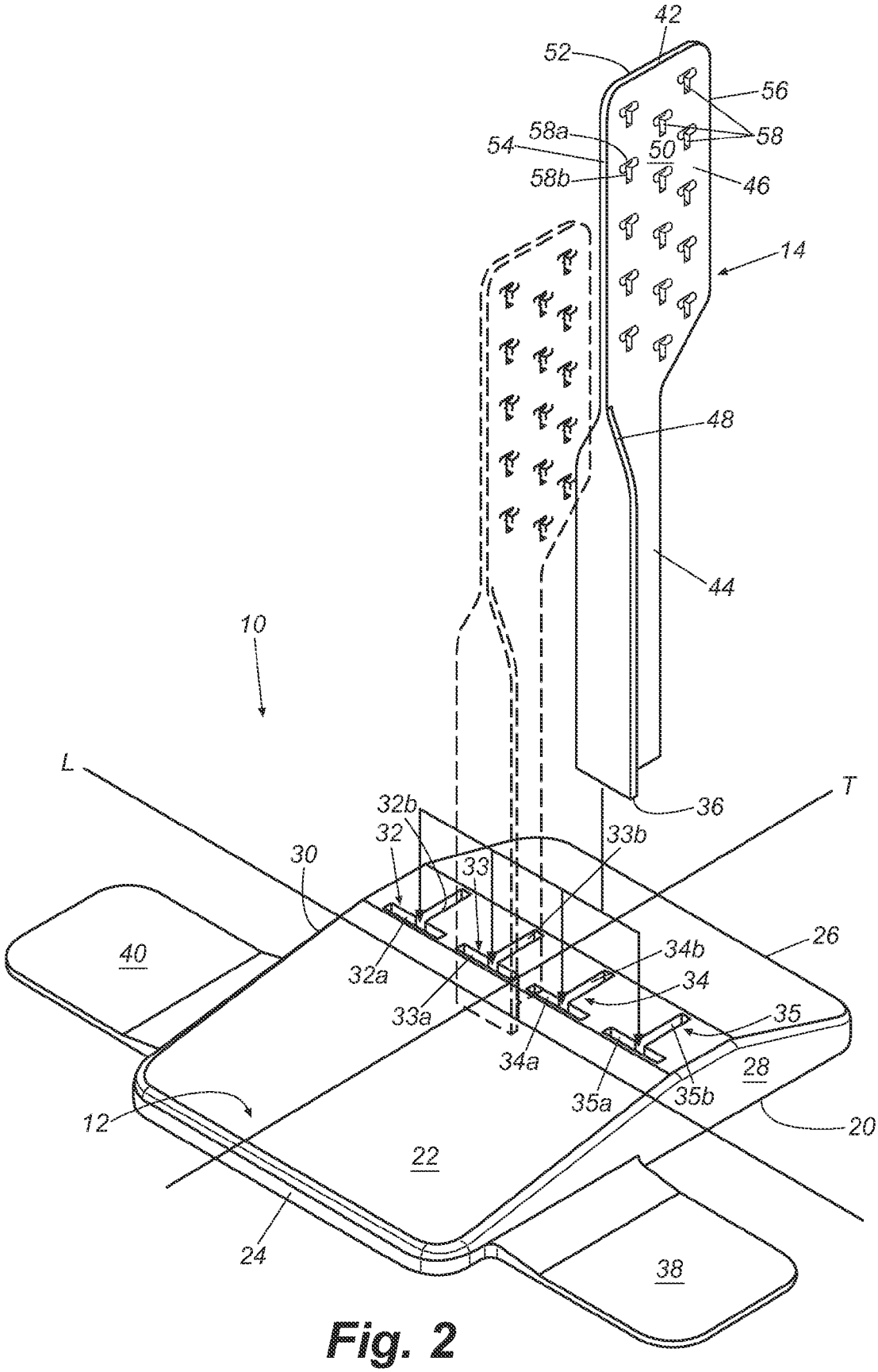
FIG. 2 is a partially exploded front perspective view of the golf swing aid shown in FIG. 1.

Referring to FIG. 2, vertical support post 14 has first end 36 and a second end 42, a first region 44 proximate first end 36 defining a T-shaped cross-section, a generally flat second region 46 proximate to second end 42 and a transition region 48 between the first and second regions. The size of vertical support post first region 44 is such that post first end 36 fits into any of base T-shaped recesses 32, 33, 34 and 35. Vertical post second region 46 has a first surface 50, a second surface 52, a front edge 54, a rear edge 56 and a plurality of spaced-apart T-shaped adjustment holes 58. Each T-shaped adjustment hole has a flange portion 58*a* and a web portion 58*b*. In one preferred embodiment, adjustment holes 58 are arranged in pattern of alternating rows having two adjustment holes and one adjustment hole, respectively, but it should be understood that the adjustment holes may be arranged in any other pattern that allows the user to selectively position transverse and longitudinal adjustment rods 16 and 18 in desired positions.

Figure 3:
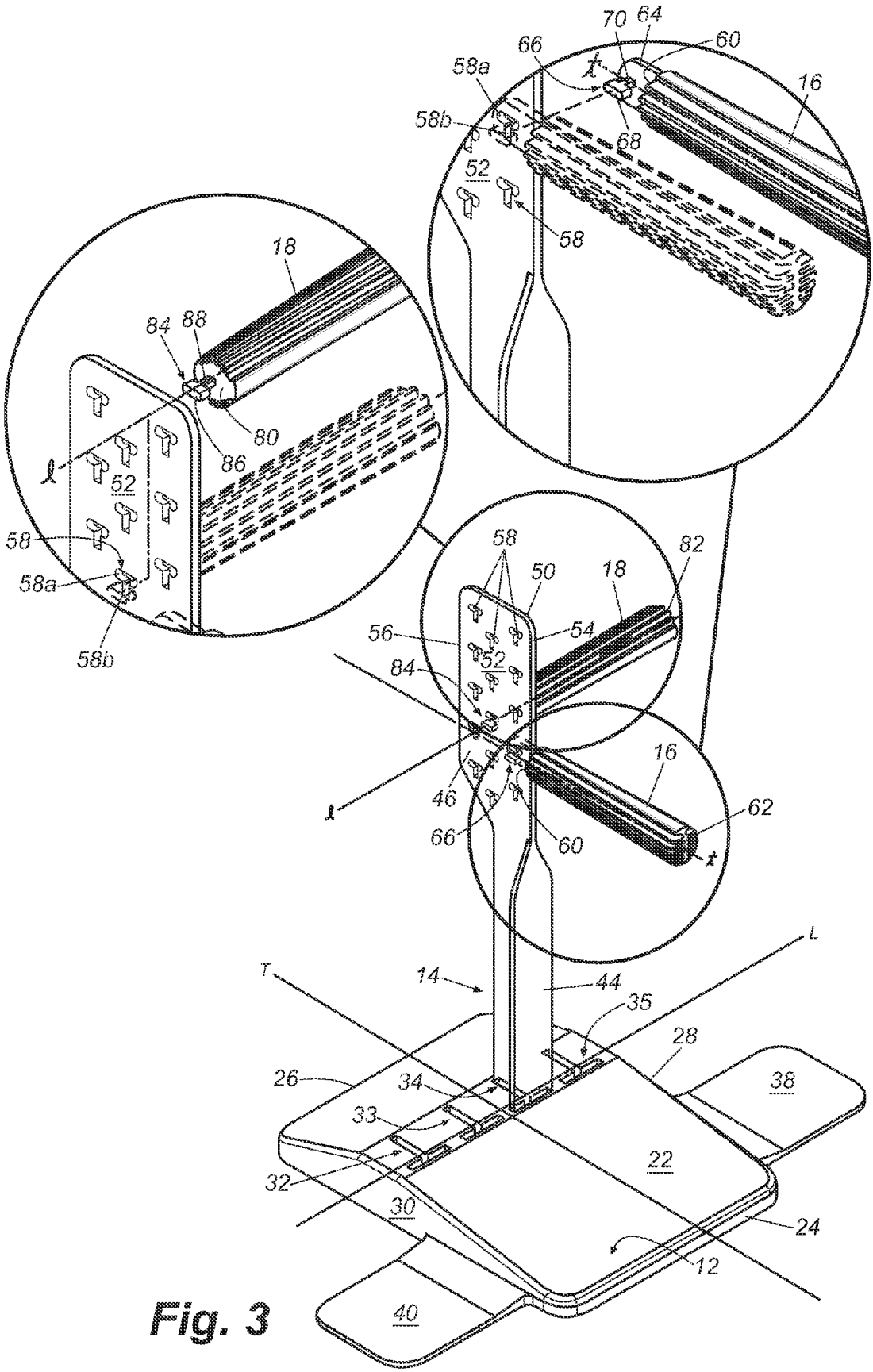
FIG. 3 is a front perspective view of the golf swing aid shown in FIG. 1.

Referring now to FIG. 3, transverse adjustment rod 16 is may be formed from extruded plastic or the like and has a generally cylindrical shape, a first end 60, a second end 62 and a longitudinal axis t. It should be understood that any suitable material may be substituted for plastic, such as aluminum, steel, or a carbon composite. Extending from transverse adjustment rod 16 is a flange 64 in a direction generally parallel to axis t. A T-shaped mounting post 66 extends from flange 64, in a direction generally perpendicular to axis t, and has a flange 68 sized appropriately to slide through a corresponding flange portion 58*a* of T-shaped adjustment hole 58. A web 70 connects T-shaped mounting post flange 68 to adjustment rod flange 64. Mounting post flange 68 is sized appropriately to fit into web portion 58*b* of T-shaped adjustment hole 58.

When the user chooses to mount transverse adjustment rod 16 to vertical post second portion 46, mounting post flange 68 is placed through a chosen flange portion 58*a* until transverse adjustment rod flange 64 engages vertical post second portion first surface 50. Once flange 64 engages pivot surface 50, the user may then slide transverse adjustment rod 16 vertically downward so that T-shaped mounting post web 70 slides into adjustment hole web 58*b*, thereby locking the transverse adjustment rod onto the vertical post second portion 46. When properly assembled, mounting post flange 68 engages vertical post second portion second surface 52 while adjustment rod flange 64 engages vertical post second portion first surface 50. Additionally, transverse adjustment rod first end 60 engages vertical post front edge 54. The engagement between transverse adjustment rod 16 and vertical post second portion 46 provides sufficient support to securely lock adjustment rod 16 in an outwardly extending position with respect to second region front edge 54. In this mounted position, transverse post longitudinal axis t and base transverse axis T are generally parallel to each other. It should be understood that golf aid 10 is also designed to provide the user with the option of mounting transverse adjustment rod 16 onto vertical post second region 46 so that rod 16 extends outwardly from second region rear edge 56 depending on the golf aid's use.

It should be understood that a threaded fastener may be substituted for T-shaped mounting post 66. In such an embodiment (not shown), a circular through-hole may be provided in adjustment rod flange 64, and a plurality of circular through-holes may replace T-shaped adjustment holes 58 in vertical post second section 46. In this alternative embodiment, the user may align the adjustment rod flange through-hole with a vertical post second section adjustment hole and insert the threaded fastener through the aligned holes. A nut (not shown) or other suitable fastener can be used to secure the adjustment rod to the vertical post second portion.

Longitudinal adjustment rod 18 is also preferably formed from extruded plastic or other suitable material and has a generally cylindrical shape, a first end 80, a second end 82 and a longitudinal axis 1. It should be understood that any suitable material may be substituted for plastic, such as aluminum, steel, or a carbon composite. A T-shaped mounting post 84 extends outwardly from longitudinal adjustment rod first end

80 in a direction generally parallel to axis 1. T-shaped mounting post 84 has a flange 86 sized appropriately to slide through a corresponding T-shaped adjustment hole flange portion 58*a*. A web 88 connects T-shaped mounting post flange 86 to longitudinal adjustment rod first end 80 and is sized appropriately to fit into the web portion 58*b* of an adjustment hole 58.

When the user chooses to mount longitudinal adjustment rod 18 to the vertical post second portion 46, mounting post flange 86 slides through adjustment hole flange portion 58*a* until adjustment rod first end 80 engages first surface 50 of vertical post second portion 46. The user may then slide the longitudinal adjustment rod downward so that rod mounting post web 88 slides into adjustment hole web 58*b*, thereby locking the longitudinal adjustment rod onto the vertical post second portion 46. Because mounting post flange 86 and post first end 80 both engage vertical post second portion 46, longitudinal adjustment rod 18 acts as a cantilever beam extending outwardly from vertical post second region, first surface 50 and longitudinal adjustment post axis 1 is generally parallel to base longitudinal axis L. It should be apparent that a user may affix longitudinal adjustment post 18 to vertical post second portion 46 so that post 18 extends outwardly from second surface 52 instead of 50 depending on the golf aid's use.

It should also be understood that in an alternative embodiment (not shown), a threaded stud (not shown) extending from rod first end 80 may be substituted for T-shaped mounting post 84, and a plurality of circular through-holes (not shown) may be substituted for T-shaped adjustment holes 58. In such an embodiment, a user would slip the threaded stud through any of the adjustment holes and tighten a nut (not shown) onto the threaded stud. The compression force of the nut and longitudinal adjustment rod first end 80 acting on vertical post second portion 46 would secure the adjustment rod to the vertical post second portion.

Referring again to FIG. 2, after deciding what particular aspect of the golf game to practice, a user 2 (FIG. 4) may insert vertical post first end 36 14 into any one of T-shaped recesses 32, 33, 34 or 35 formed in base 12. Each of the T-shaped recesses provides the user with an opportunity to focus on various aspects of the golf swing. Additionally, the various locations of the T-shaped recesses allow the device to be used by both right and left-handed golfers.

Figure 4:
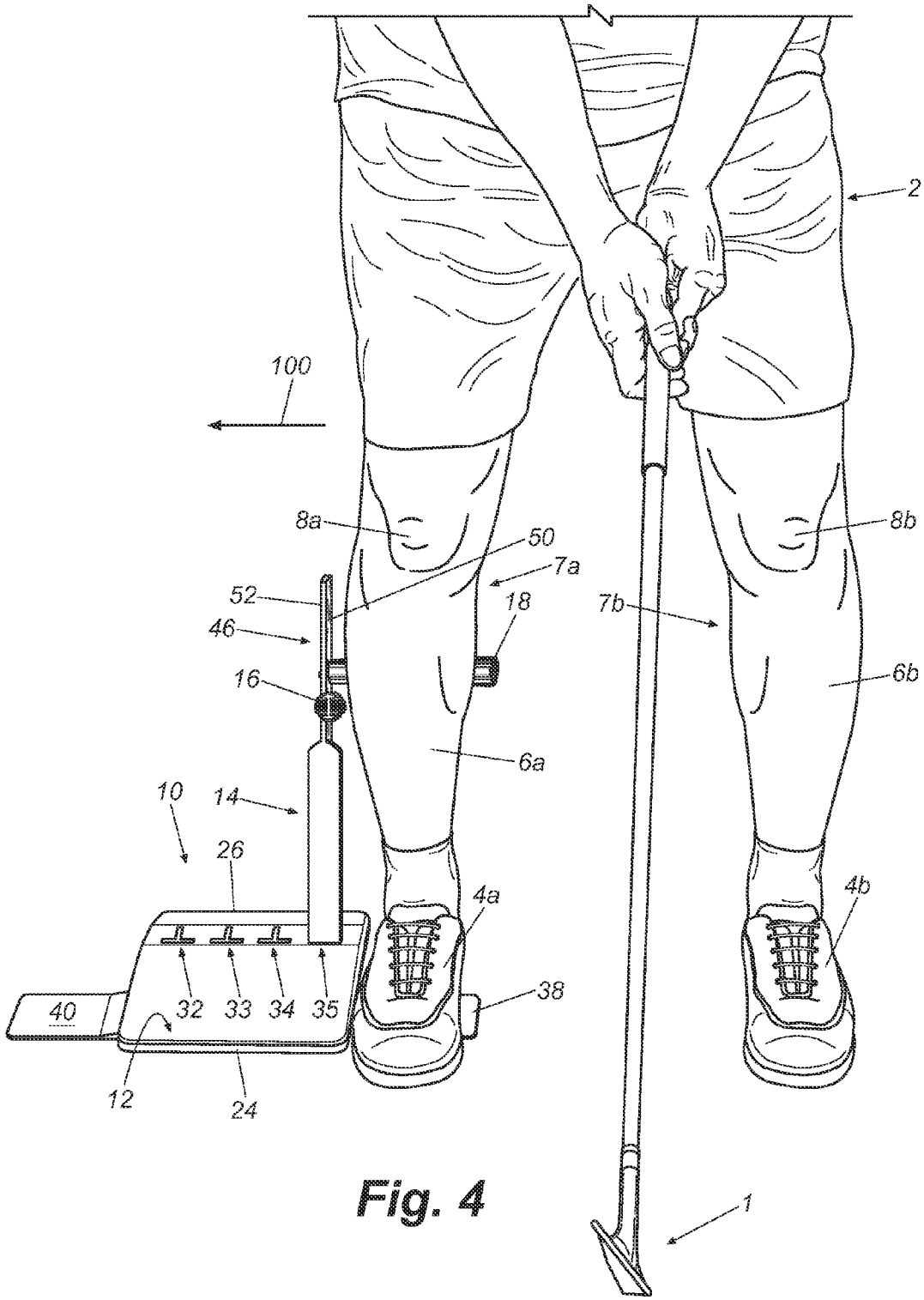
FIG. 4 is a front perspective view of the golf swing aid shown in FIG. 1 while in use.

Referring to FIG. 4, if user 2 is a right-handed golfer, placing vertical post 14 in T-shaped recess 35 allows the user to stand with his or her right foot 4*a* resting on stability wing 38 so that the toe of the shoe located proximate to base front wall surface 24. In this arrangement, if lateral adjustment rod 18 is affixed so that it extends outwardly from vertical post second portion first surface 50, the lateral adjustment rod makes contact with a calf portion 7*a* of the user's right leg 6*a*. The plurality of adjustment holes 58 (FIGS. 1, 2, and 3) formed in vertical post second portion 46 allow the user to selectively position lateral adjustment rod 18 so that the contact between calf 7*a* and rod 18 promotes optimal comfort and instructional benefit. Additionally, user 2 may also selectively position transverse adjustment rod 16 at a vertical position that promotes comfortable and beneficial contact between rod 16 and the user's leg 6*a* during a reward portion of a swing. This arrangement allows a right-handed golfer to practice the golf swing, but prevents the golfer from shifting laterally in the direction of arrow 100 during the course of the golf swing. Thus, the golf aid prevents the user's hips 2 from shifting laterally in the direction of arrow 100.

Figure 5:
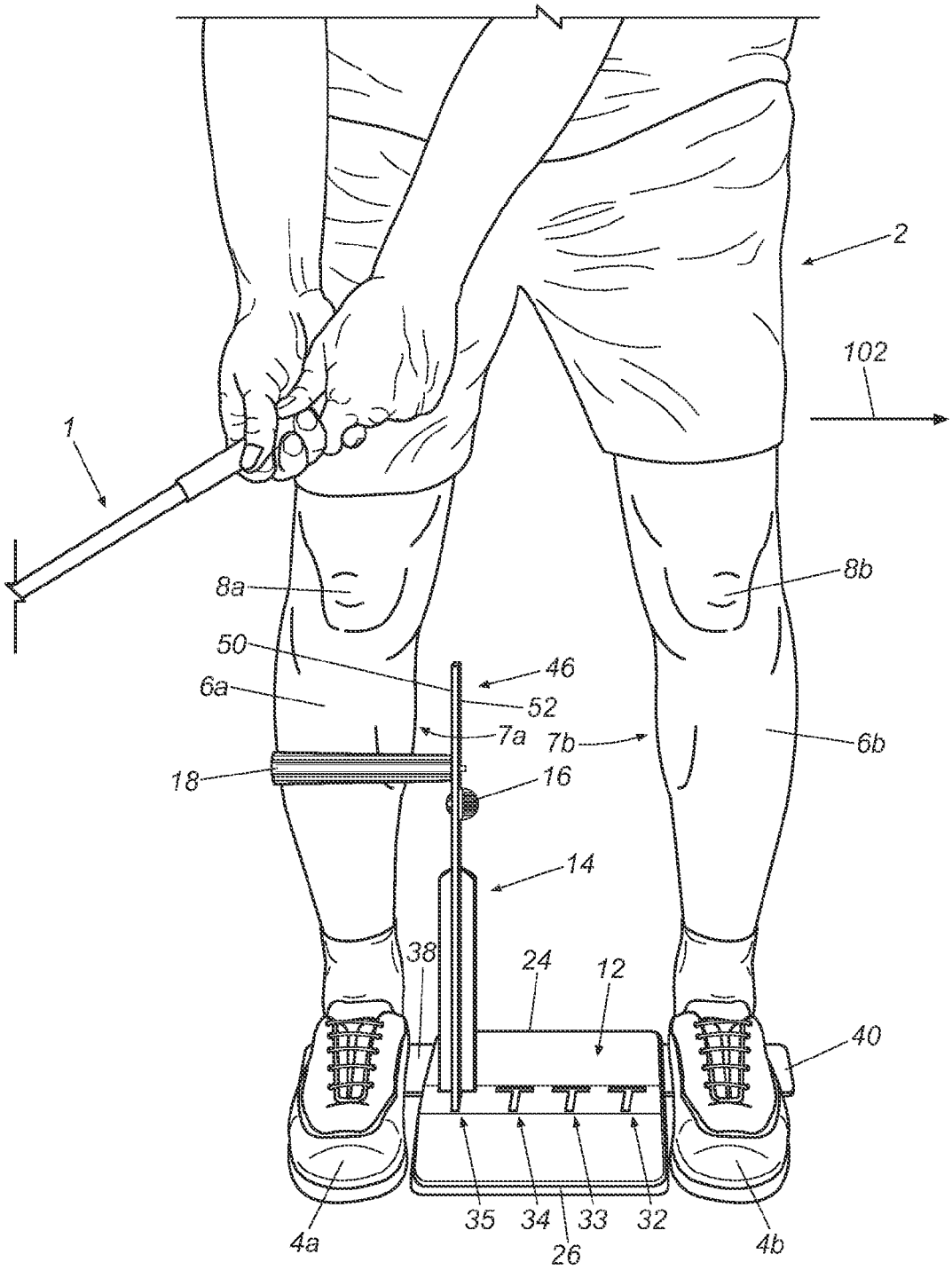
FIG. 5 is a rear perspective view of the golf swing aid shown in FIG. 1 while in use.

Referring now to FIG. 5, user 2 is shown using golf swing aid 10 in an alternative manner, where the user stands with his right foot 4*a* resting on stability wing 38 and his left foot 4*b* resting on stability wing 40. The toes of the shoes are generally aligned with base rear wall surface 26, and longitudinal adjustment rod 18 makes contact with the user's right shin 6*a* slightly below the right knee 8*a*. Simultaneously, transverse adjustment rod 16 is positioned between legs 6*a* and 6*b* proximate to the inner calf of right leg 6*a*. In this arrangement, the user may use base rear wall surface 26 to assist in aligning the feet correctly. During the golf swing, longitudinal adjustment rod 18 contacts either the front or back of the user's right leg 6*a*, preventing the user from severely flexing knee 8*a*. Simultaneously, longitudinal adjustment rod 16 prevents the user from shifting in the direction of arrow 102, thereby preventing the user from shifting his hips 2 laterally in the direction of arrow 102. Should the user shift in direction 102 during the forward portion of his swing, the user will feel his or her right leg 6*a* slide against transverse adjustment rod 16, and the user can stop the golf swing to adjust his swing mechanics to correct such a shift.

The uses shown in FIGS. 4 and 5 are merely examples of the versatile nature of the present invention. From the foregoing discussion, it should become apparent that a golf swing aid in accordance with the present invention allows the user wide flexibility in positioning the vertical post 14, as well as transverse and longitudinal adjustment rods 16 and 18. The four base T-shaped recesses 32, 33, 34 and 35 allow the user to adjust the positioning of vertical support post 14 in any of four positions along the longitudinal axis of the base. The plurality of adjustment holes 58 (FIGS. 1, 2, and 3) formed in the second region of the vertical post allow the user to position the transverse and longitudinal adjustment rods in a number of positions suitable for assisting in various aspects of the golf swing and accommodating the varying heights of potential users. Additionally, the user may choose to rotate base 12 so that the user stands with his or her feet on the stability wings and aligns their toes with either the base front or rear wall surfaces 24 or 26. Finally, the user may remove the vertical support post 14 from base 12 altogether and use the base 12 as a tool for aligning their feet or for helping the user determine the proper distance between the instep of his or her feet when preparing to make a golf swing.

It should be understood that transverse adjustment rod 16 may be attached to vertical post second portion 46 extending from either of front edge 54 or rear edge 56 depending whether the user swings right or left handed and the swing mechanics that are being adjusted. Additionally, as with the transverse adjustment rod, longitudinal adjustment rod 18 may be mounted so that it either extends from vertical post second portion first or second surfaces depending on the swing mechanics that are being adjusted. As a result, swing aid 10 can be easily configured to work on a users back swing, front swing, chipping swing and putting stroke by simply positioning the vertical post and the transverse and longitudinal adjustment rods to one of the many adjustment locations. Thus, a single device allows a user to work on various aspects of their golf stance and swing.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A golf aid for assisting a golfer in properly maintaining alignment, balance, and lower body biomechanics comprising:

a. a generally rectangular base having i. a bottom surface, and ii. a top surface defining a plurality of openings formed therein, b. a vertical support post having i. a first end, ii. an opposite second end, iii. a longitudinal axis extending between said vertical support post first and second ends, iv. a first post region proximate to said vertical support post first end that releasably engages one of said base plurality of openings so as to couple said vertical support post in a position generally normal to said base bottom surface, and v. a second vertical support post region proximate to said vertical post second end defining a generally planar front surface, a generally planar back surface, a sidewall therebetween and a plurality of holes therethrough, c. a first rod having i. a first end, ii. an opposite second end, iii. a longitudinal axis extending therebetween, and iv. a mounting post extending from said first rod first end, wherein said first rod mounting post is received in one of said second post region plurality of holes to releasably secure said first rod to said vertical support post second region so that said first rod longitudinal axis is generally normal to one of said second post region generally planar front and back surfaces, and d. a second rod having i. a first end, ii. an opposite second end, iii. a longitudinal axis extending therebetween, iv. a flange extending from said second rod first end, said flange being parallel to said second rod longitudinal axis, and v. a mounting post extending from said second rod flange, wherein said second rod mounting post is received in one of said second post region plurality of holes to releasably secure said second rod to said second post region so that said second rod longitudinal axis is generally parallel to one of said second post region generally planar front and back surfaces and generally normal to said second post region sidewall.

2. The golf aid of claim 1, said base further comprising:

a. a front wall extending between said base top and bottom surfaces;

b. a rear wall extending between said base top and bottom surfaces and generally parallel to said base front wall;

c. a right sidewall extending between said front and rear walls; and d. a left sidewall extending between said front and rear walls.

3. The golf aid of claim 2, said base further comprising:

a. a right flange extending outwardly from said right sidewall; and b. a left flange extending outwardly from said left sidewall.

4. The golf aid of claim 1, wherein said first rod longitudinal axis and said second rod longitudinal axis are generally perpendicular to said vertical support post longitudinal axis and are generally perpendicular to each other.

5. The golf aid of claim 1, wherein said first rod mounting post has a T-shaped cross-section including a first flange section and a first web section connecting said first flange section to said first rod first end, said second rod mounting post has a T-shaped cross-section including a second flange section and a second web section connecting said second flange section to said second rod flange, and each of said plurality of adjustment holes has a horizontal opening through which either of said first or said second flange sections may pass and a vertical opening that releasably receives either of said first or said second web sections.

6. The golf aid of claim 1, wherein said base plurality of openings are generally T-shaped and said vertical support post first end has a T-shaped cross-section perpendicular to said vertical support post longitudinal axis.

7. A golf aid for assisting a golfer in properly maintaining alignment, balance, and lower body biomechanics comprising:

a. a base having a bottom surface and a top surface defining a plurality of openings therein;

b. a vertical support post having a first end for releasably engaging one of said base plurality of openings, a second end defining a plurality of holes therethrough, a longitudinal axis extending between said first and said second ends, wherein when said vertical support post first end is inserted into one of said base plurality of openings, said vertical post longitudinal axis is substantially perpendicular to one of said base bottom and top surfaces;

c. a first rod having a first end, a second end, a longitudinal axis therebetween, and a mounting post extending from said first rod first end for releasably engaging one of said vertical support post second end plurality of holes; and d. a second rod having a first end, a second end, a longitudinal axis extending therebetween, and a mounting post extending from said second rod first end for releasably engaging another of said vertical support post second end plurality of holes.

8. The golf aid of claim 7, wherein said base is generally rectangular in shape.

9. The golf aid of claim 8, said base further comprising at least one flange extending from said base, said flange being orientated generally parallel to one of said base top and bottom surfaces.

10. The golf aid of claim 7, wherein said first rod mounting bracket has a first flange section and a first web section connecting said first flange section to said first rod first end;

said second rod mounting post has a second flange section and a second web section connecting said second flange section to said second rod first end; and each of said vertical support post second end plurality of holes has a horizontal opening through which one of said mounting post first and second flange sections pass through and a vertical opening that releasably receives a respective mounting post first and second web section.

11. The golf aid of claim 7, wherein when said first and said second rods are coupled to said vertical support post second end, said first rod longitudinal axis and said second rod longitudinal axis are generally perpendicular to one another.

12. A golf aid for assisting a golfer in properly maintaining alignment, balance, and lower body biomechanics comprising:

a. a base having a plurality of openings formed in a top surface and a first generally planar flange extending from a side of said base, wherein a top surface of said first generally planar flange is generally parallel to a bottom surface of said base;

b. a vertical support post having a first end, an opposite second end, a longitudinal axis extending therebetween, and a plurality of holes formed at said vertical support post second end; and c. a first adjustment rod having a first end, a second end, a longitudinal axis extending therebetween, and a mounting post coupled to said first rod first end;

wherein said vertical support post first end being releasably received in one of said base plurality of openings, and said first rod mounting post is releasably received in one of said vertical support post second end plurality of holes so that said first rod longitudinal axis is orientated generally perpendicular to said vertical support post longitudinal axis.

13. The golf aid of claim 12, further comprising a second rod having a first end, a second end, a longitudinal axis extending therebetween, and a mounting post coupled to said second rod first end, wherein said second rod mounting post is releasably received in another of said vertical support post second end plurality of holes so that said second rod longitudinal axis is orientated generally perpendicular to said vertical support post longitudinal axis.

14. The golf aid of claim 13, wherein said first rod longitudinal axis and said second rod longitudinal axis are generally perpendicular to one another.

15. The golf aid of claim 13, wherein when a user stands on said first base flange, said first rod is positioned to contact one of an inside and an outside of the user's leg and said second rod is positioned to contact one of a front and a back of the user's same leg.

16. The golf aid of claim 12, said base further comprising a second generally planar flange located on an opposite side of said base from said first generally planar flange, wherein a top surface said first and said second generally planar flanges are co-located in the same plane.

17. The golf aid of claim 12, wherein said first adjustment rod mounting post further comprises a first flange section and a first web section connecting said first flange section to said first adjustment rod first end;

each of said vertical support post second end plurality of holes comprises a horizontal opening through which said first rod first flange section passes and a vertical opening in which said first rod first web section is received so that said first rod first flange engages a first surface of said vertical support post second end and said first rod first end engages an opposite second surface thereby locking said first rod to said vertical support post.

18. The golf aid of claim 12, wherein said base plurality of openings are generally T-shaped and said vertical support post first end has a generally T-shaped cross-section taken perpendicular to said vertical support post longitudinal axis, said vertical support post first end being sized to snuggly fit into each of said base plurality of openings.

* * * * *